US007798246B2

(12) United States Patent
Collins

(10) Patent No.: US 7,798,246 B2
(45) Date of Patent: Sep. 21, 2010

(54) APPARATUS AND METHOD TO CONTROL THE ROTATION OF A DOWNHOLE DRILL BIT

(75) Inventor: Anthony L. Collins, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 216 days.

(21) Appl. No.: 11/420,915

(22) Filed: May 30, 2006

(65) Prior Publication Data

US 2008/0083564 A1 Apr. 10, 2008

(51) Int. Cl.
*E21B 47/00* (2006.01)
*E21B 47/024* (2006.01)

(52) U.S. Cl. ..... 175/40; 175/45

(58) Field of Classification Search ..... 175/45, 175/40; 702/41; 73/152.49
See application file for complete search history.

(56) References Cited

U.S. PATENT DOCUMENTS 3,788,136 A 1/1974 Park
3,855,853 A * 12/1974 Claycomb ..... 73/152.48
4,136,559 A * 1/1979 Brown ..... 73/862.328
4,597,289 A * 7/1986 Obrecht ..... 73/152.48
4,695,957 A 9/1987 Peltier
5,431,046 A * 7/1995 Ho ..... 73/152.54
6,192,748 B1 * 2/2001 Miller ..... 73/152.01
6,356,847 B1 * 3/2002 Gerlitzki ..... 702/41
6,401,838 B1 6/2002 Rezmer-Cooper
6,585,041 B2 7/2003 Crossley
6,648,082 B2 * 11/2003 Schultz et al. ..... 175/39
6,796,390 B1 9/2004 Bakker
7,004,021 B2 * 2/2006 Bilby et al. ..... 73/152.43
7,219,747 B2 * 5/2007 Gleitman et al. ..... 175/40
2004/0144547 A1 7/2004 Koithan et al.
2004/0251027 A1 12/2004 Sonnier et al.
2005/0071120 A1 3/2005 Hutchinson
2005/0194185 A1 * 9/2005 Gleitman ..... 175/45
2005/0211470 A1 9/2005 Jeffreys
2005/0279532 A1 * 12/2005 Ballantyne et al. ..... 175/40
2005/0284659 A1 12/2005 Hall et al.
2006/0063631 A1 3/2006 Jones
2006/0065440 A1 3/2006 Hutchinson

* cited by examiner

*Primary Examiner*—Jennifer H Gay
*Assistant Examiner*—Cathleen R Hutchins
(74) *Attorney, Agent, or Firm*—David J. Smith

(57) ABSTRACT

An apparatus and method to control the rotation of a downhole drill bit are disclosed. A pair of spaced-apart measuring or survey instruments at the drill string provide data that is analyzed to determine relative rotation between the instruments so that drag affecting the drill bit may be reduced.

22 Claims, 3 Drawing Sheets

APPARATUS AND METHOD TO CONTROL THE ROTATION OF A DOWNHOLE DRILL BIT

FIELD OF THE DISCLOSURE

This disclosure relates generally to an apparatus and method to control the rotation of a downhole drill bit and, more particularly, to utilizing the downhole measurements of magnetometer or accelerometer assemblies to control the rotation of a drill bit to reduce drag thereon.

BACKGROUND

Typically, drilling rigs at the earth surface are used to drill lengthy boreholes into the earth to reach the location of subsurface oil or gas deposits and establish fluid communication between the deposits and the surface via the borehole. Downhole drilling equipment may be directed or steered to the oil or gas deposits using well-known directional drilling techniques, which may rely on the direction and orientation of downhole survey instruments that can be monitored at survey locations along the borehole.

Surveying of boreholes is typically performed by utilizing downhole survey instruments such as, for example, accelerometers and magnetometers coupled within a bottom hole assembly (BHA). The BHA is typically coupled in the drill string (e.g., the drill pipe or the drill collars) above the drill bit. The survey instruments may be used to measure the direction and magnitude of the local gravitational and magnetic field vectors to determine the azimuth and the inclination of the borehole at each survey location within the borehole. The survey measurements may be performed during drilling using a process commonly referred to as measurement while drilling (MWD). Generally, separate borehole surveys are conducted at the survey locations along the borehole when drilling is stopped or interrupted to couple additional stands of drill pipe to the drill string at the surface.

The direction of a drilled borehole within any segment of the borehole is usually determined by the method of drilling and the arrangement of the drilling equipment used to drill the segment of the borehole. For directional drilling using a bent stub and a mud motor, two known methods of drilling produce distinctive borehole trajectories. One known method referred to as rotating involves the rotation of the entire drill string, including the BHA. In this method, the bent stub is in straight line borehole trajectory. Although deviations from a true linear trajectory typically exist due to gravity, misalignment of equipment, etc.

A second known method of drilling referred to as sliding has the bent sub in a deployed or angular position to selectively adjust the angular position of the bit shaft relative to the drill collar. Using the sliding method, the drill bit is rotated by the mud motor instead of by the rotation of the drill string. Sliding produced a drilled borehole having a curved or generally arc-shaped trajectory. In practice, sliding produces boreholes that deviate from a true arc-shaped trajectory for the same reasons that rotating drilling processes produces boreholes that deviate from a true linear trajectory.

the rotation applied to a drill bit and the resulting torque (torque-on-bit or TOB) are important data that can be used to determine drill bit wear and drilling direction. However, during either rotating or sliding drilling there is usually some inefficiency associated with transmitting rotational torque to the drill bit. This inefficiency is commonly called drag, which may be defined as a retarding force exerted on a moving body by a medium. Surface measurements of TOB may not be accurate because factors such as, for example, borehole curvature, hole deformation and packing of stabilizers all contribute to drag that cannot be readily determined at the surface.

Various systems have been devised for conducting downhole measurements and transmitting these measurements uphole to the surface during drilling. One known system measures torque using string gages attached to a drill collar. However, signals produced by the bending of the collar may be larger that the torque signal and induce drift in the strain gages. Additionally, the relaxation of stresses in the drill collar can produce signals as large as the torque to be sensed by the strain gages.

Another known system is a wireline tool that includes one or more survey probes suspended by a cable and raised and lowered into and out of the borehole. A free part indicator tool probe can measure the angular and axial displacement between two anchored sections of the boreline tool, but such a probe cannot be utilized during drilling to make reliable measurements.

Piezo-magnetic sensors have also been proposed for making downhole MWD, but such sensors have limitations similar to those of strain gages. Additionally, the crushing and grinding of the drill bit against rock at the bottom of the borehole, the engagement of the drill string with the surfaces of the borehole, and the stresses experienced by the joints of the drill pipe and the drill collars, all combine to produce noise, shock and vibrations that corrupt measurements of the earth's magnetic and gravitational fields, thereby rendering such downhole measurements or data unusable for determining accurately the characteristics of the borehole.

SUMMARY OF THE INVENTION

In accordance with one example, a method to control the rotation of a drill string to reduce drag affecting the drill bit comprises measuring at spaced-apart locations, with at least one of magnetic or gravitational field responsive measuring instruments, a plurality of components of a field strength, wherein one of the measuring instruments is proximate the drill bit, determining the relative rotation between the measuring instruments, and operating the drill string to reduce drag affecting the drill bit. Additionally, the relative rotation may be processed to determine a loss of torque proximate the drill bit.

In accordance with another example, an apparatus to control the rotation of a drill bit comprises a first measuring instrument and a second measuring instrument to be coupled at spaced-apart locations of a drill string, wherein the measuring instruments include at least one of magnetometers or accelerometers to measure a plurality of components of a field strength, and a data processing system to communicate with the measuring instruments to determine the relative rotation between the measuring instruments to enable a reduction of drag affecting the drill bit. Additionally, the data processing system may be configured to provide an offset to compensate for downhole make-up of the drill string.

DETAILED DESCRIPTION

In general, the example apparatus and method described herein to control the rotation of a drill bit may be utilized for MWD in various types of drilling operations to reduce the drag affecting a drill bit. Additionally, while the examples described herein are described in connection with drilling operations for the oil and gas industry, the examples described herein may be more generally applicable to a variety of drilling operations for different purposes.

The example apparatus and method to control the rotation of a drill bit utilizes MWD to survey the torque applied to a length of a cylindrical downhole object such as length of drill collar or length of drill pipe. In particular, the rotations of the ends of the length of drill collar or drill pipe are detected and processed to determine the relative rotation between the ends. The relative rotation is used to compare the amount of torque applied proximate the drill bit with the amount of torque applied proximate the earth's surface. This torque information may be used to control the rotation of the drill string to responsively and efficiently apply a desired torque proximate the drill bit.

Figure 1:
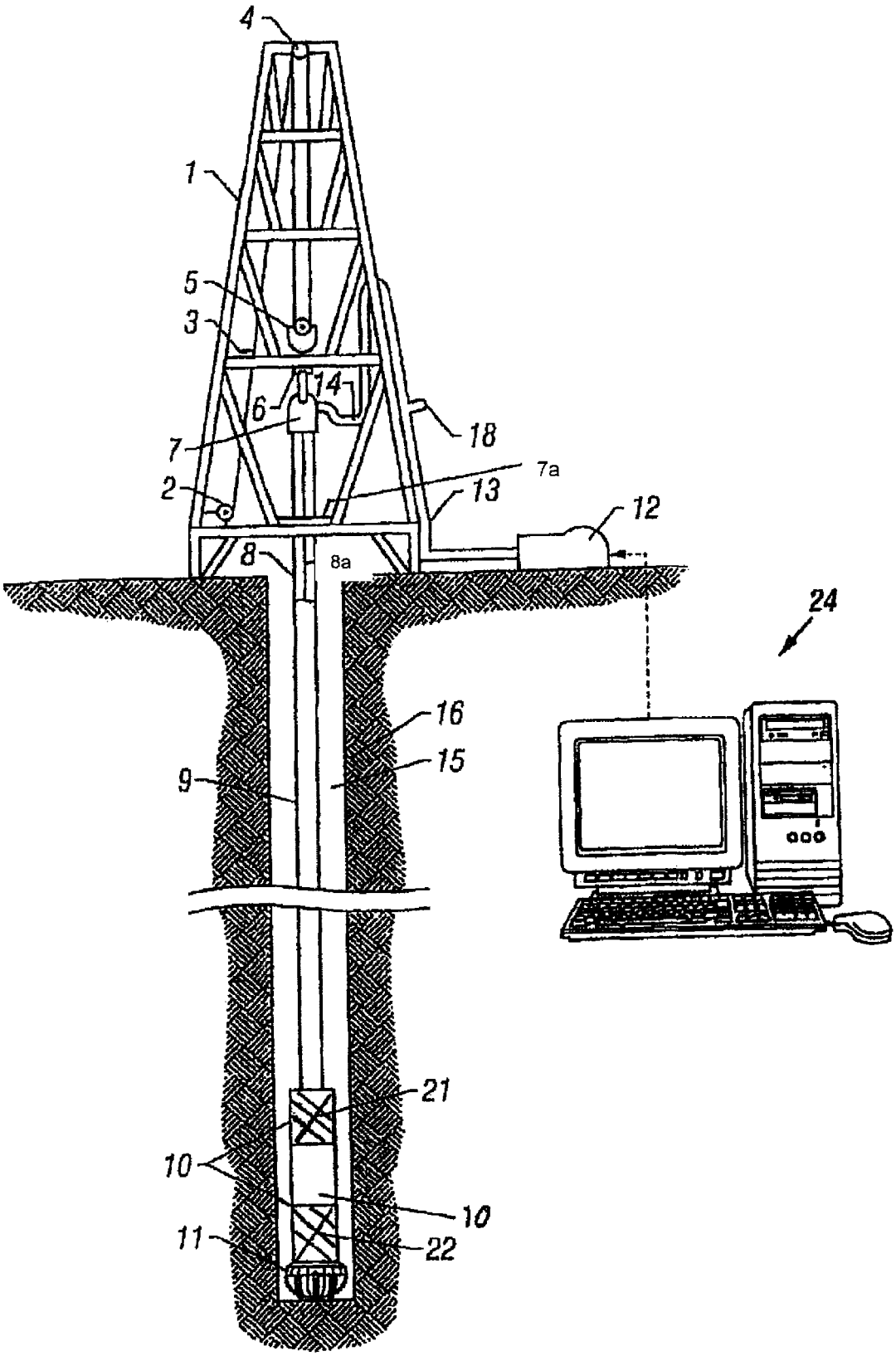
FIG. 1 is an illustration of an example drilling operation including a drilling rig, a drill string including separated survey instruments, a drilling mud circulating system and a data processor.

FIG. 1 is an illustration of an example drilling operation including a drilling rig or derrick 1 having a drawworks 2, a cable 3, a crown block 4, a traveling block 5, and a hook 6, supporting a drill string 8, which includes a swivel joint 7, a kelly 7*a*, drill pipe 9, drill collars 10, and a drill bit 11. Mudpumps 12 circulate drilling fluid (e.g., drilling mud) through a standpipe 13 and a flexible hose 14, down through a drilling mud passage 8*a* in the hollow drill pipe 9 and the drill collars 10 to a mud motor (not shown) to operate the drill bit 11, and back to the surface through an annular space 15 between the drill string 8 and the borehole wall 16.

While drilling a borehole for oil or gas production by rotating the drill string 8, including the drill bit 11 connected to the bottom of the drill string 8, it is advantageous to determine periodically the torque transmitted to the drill bit 11. The example apparatus and method illustrated in FIG. 1 uses a set of axially separated measuring or survey instruments 21 and 22 located along a length of the drill collars 10. Although the survey instruments 21 and 22 are illustrated as being associated with the drill collars 10, the survey instruments 21 and 22 can be located alternatively along the length of the drill pipe 9. The preferred axial separation of the instruments 21 and 22 is about thirty feet when mounted along the drill pipe 9 or about ninety feet when mounted along the drill collars 10. The preferred maximum length of axial separation is about ninety feet when the instruments 21 and 22 are mounted along the drill pipe 9. However, other lengths of axial separation may be used to suit the needs of particular applications.

Figure 2:
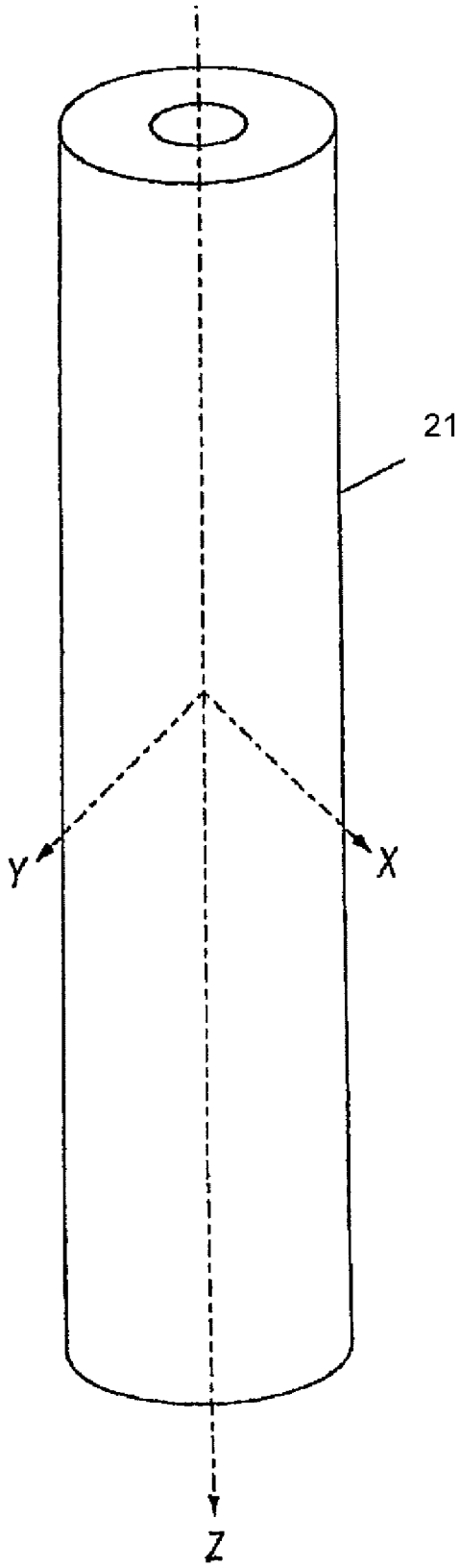
FIG. 2 depicts a survey instrument showing the origin of the tool-fixed coordinate system used for a borehole survey.

The survey instruments 21 and 22 may be two or three-axis magnetometers or two or three-axis accelerometers. In general, the magnetometers or accelerometers are used to measure the earth's local magnetic or gravitational field with respect to a tool-fixed coordinate system such as, for example, a three-axis coordinate system within the survey instrument 21 as depicted in FIG. 2. As is well-known, a three-axis coordinate system has one axis disposed substantially parallel to the Z axis of the survey instrument 21, and the other two axes positioned substantially orthogonally relative to the Z axis and substantially parallel to the X and Y axes of the survey instrument 21, as shown in FIG. 2.

A three-axis survey instrument 21 or 22 provides three output signals corresponding to the X, Y and Z components of the earth's magnetic or gravitational fields. Typically, the survey instruments 21 and 22 are magnetometers that sense the transverse field of the earth's magnetic field. However, if the borehole has an essentially linear trajectory and is substantially parallel to the earth's magnetic field such that the transverse field being sensed is inadequate (e.g., too weak) to provide a reliable measurement, the survey instruments 21 and 22 may be accelerometers so that the orientation of the instruments relative to the earth's gravity (vertical) may be sensed instead.

The example apparatus and method to control the rotation of a drill bit described herein may utilize magnetometers within the survey instruments 21 and 22. When the drill string 8 is rotated, the magnetometers whiting the survey instruments 21 and 22 sense the earth's magnetic field at the respective downhole locations of the magnetometers, and each magnetometer generates a sinusoidal wave (output signal or data) having a frequency equal to the angular rate of rotation of the drill string 8 at the downhole location and proportional to the degree of rotation. The output signals of the survey instruments 21 and 22 are compared to determine the phase difference between the two rotating ends of the drill pipe 9 or the drill collars 10. The relative angle of rotation Θ can then be used in Equation 1 set forth below to determine the torque applied proximate the drill bit 11.

$$T = \frac{\Delta\Theta}{\int \frac{dl}{GJ}}$$

Where $T$ is torque $G$ is the Shear modulus $J$ is the polar moment of inertia $L$ is length The polar amount of inertia J is related to the material of the drill string 8 between the survey instruments 21 and 22, and the length l is the distance between the survey instruments 21 and 22. Referring to FIG. 1, a data processing systems 24 compares the torque T to the torque applied to the drill string 8 and measured at the surface of the earth to determine a loss of torque affecting the drill bit 11.

To measure and process simultaneously the output signals, the survey instruments 21 and 22 are coupled to a communication system (not shown) that is synchronized. Referring to FIG. 1, the output signals or data (magnetic or gravitational) sensed by the survey instruments 21 and 22 are transmitted to the surface by the well-known technique of mud pulse generation (mud telemetry). More specifically, a modulating valve (not shown) placed within the drill pipe 9 or the drill collars 10 adjacent the drilling mud passage 8*a* causes the pressure pulses to propagate in the mud column up the drill string 8, where they are detected by a pressure transducer 18 placed in the standpipe 13 and communicated to a data processing system 24, which may be placed at or adjacent the illustrated drilling equipment. However, any other suitably synchronized communications may be used instead.

If the relative angle of rotation between the ends of the length of drill pipe 9 or the drill collars 10 is 0.001 radian (0.06 degree) while the drill string 8 is rotating at 200 revolutions per minute, the communication of such data requires a time accuracy (or maximum synchronization error) of about fifty microseconds. This is well within the capability of a mud telemetry system such as the Local Tool Bus (LTB) system utilized by the assignee of this patent application. The LTB utilizes a 250 KHz carrier frequency that is frequency modulated between 200 to 300 KHz to provide time increments capable of sending an appropriate signal. As an alternative to a mud telemetry system, a wire drill pipe (WDP) can be utilized to transmit sensed data to the surface. The WDP includes wires and couplers built into the drill pipe 9 and has a higher bandwidth signal, which can easily convey signals communicated via electrical connections to the data processing system 24 located at the surface of the earth.

Once the sensed data is processed by the data processing system 24 to determine any relative rotation and loss of torque being transmitted to the drill bit 11, other information or data related to the drill string 8 and the borehole may provide indications of environmental factors or other factors that may cause or contribute to creating drag affecting the drill bit 11. Numerous corrective actions may be initiated to respond to the downhole environmental factors or other factors that may be causing the loss to torque. The disclosed example apparatus and method to control efficiently the rotation of a downhole drill bit also enables the implementation of one or more corrective actions before a serious problem such as, for example, a stuck drill string, occurs. More specifically, in operation, the data processing system 24 may communicate a signal to control equipment (not shown) to achieve a change in the rotational rate of the drill string 8 to ensure that the drill bit 11 operates at the desired revolutions and torque for efficient drilling. Alternatively, the weight of the drill bit 11 (weight-on-bit or WOB) may be changed by pulling up or slacking up on the draw works 2 (see FIG. 1) to change the hook load (e.g., the load of the traveling block 5, the hook 6, and the swivel joint 7) or, if materials in the downhole are creating drag, the pump rate can be changed so that more fluid or mud is circulated. Alternatively or additionally, the properties of the mud circulated in the downhole may be changed to vary (e.g., reduce) the drag affecting rotation of the drill bit 11. For example, a pill of mud to be circulated may be modified to have different properties such as viscosity or, if the shale swelling has occurred, than the property of the entire mud system can be changed. Another alternative or additional procedure is to perform what is commonly known as a short trip (e.g., withdrawing the drill bit 11 from the borehole to the bottom of the drilling rig 1, and checking and cleaning the drill bit 11). Although requiring additional time to perform the procedure, a short trip may eliminate certain factors causing or contributing to the drag. These are only a few examples of the numerous corrective actions that can be implemented to eliminate or modify downhole environmental factors or other factors that may cause a loss of torque affecting the drill bit 11.

To increase the likelihood of identifying the source of the drag affecting the drill bit 11, more than two survey instruments 21 and 22 (e.g., one, two or more survey instruments) may be utilized along the drill string 8 and, thus, improve the capability of the example apparatus to identify the location of a retarding force along the drill string 8.

As previously disclosed, if the borehole has a substantially linear trajectory and is substantially parallel to the earth's magnetic field such that the transverse magnetic field sensed is inadequate to provide a measurement, the survey instruments 21 and 22 may be accelerometers so that the orientation of the instruments 21 and 22 with respect to the earth's gravity (vertical) may be sensed and data communicated to the data processing system 24 may be used responsively and efficiently reduce drag affecting the drill bit 11.

A change in the downhole orientation of the lengths of the drill pipe 9 and the drill collars 10 relative to one another and resulting from other than rotating drilling (e.g., such as one length of the drill pipe 9 turning at its connection with an adjacent length of the drill pipe 9) is commonly referred to as downhole make-up. Thus, when the drill pipe 9 and the drill collars 10 are not being rotated, the survey instruments 21 and 22 in the drill pipe 9 of the drill collars 10 may have different static rotational positions. It is advantageous to compensate for such as downhole make-up to properly and accurately process the measurements and signals generated by the survey instruments 21 and 22. The examples described herein compensate for differences in the static rotational positions of the survey instruments 21 and 22 so that the relative rotation between the lengths of the drill pipe 9 or the drill collars 10 being rotated is not interpreted as static torque.

One method to determine the existence of downhole make-up is top axially displace the drill string 8 without imparting any rotation of the drill string 8, and thereby determine a true zero torque reference. Another compensation method is to apply an arbitrary offset to the data transmitted to the data processing system 24. For example, assume that the static rotational positions of the survey instruments 21 and 22 are 179.1 degrees apart. The sensitivity of the survey instrument 21 or 22 is typically about 0.8 degree/k ft-lb of torque, over ninety feet of five inch drill pipe. If an offset unit is, for example, 40 degrees and a resolution of 0.1 degree is utilized, then the data sent to the data processing system 24 has removed or offset therefrom four offset (160 degrees total) units and produces 19.1 (179.1 degrees−160 degrees=19.1 degrees), which fits into a nine bit word (0 to 50 degrees) for processing. An offset of 19.1 degrees would be interpreted by the data processing system 24 as approximately 25 k ft-lb (19.12 degrees/0.8 degrees/k ft-lb=25 k ft-lb) that would be offset from the measured relative rotational torque between the survey instruments 21 and 22. If additional downhole make-up should occur, then the initial measurement and calculation of the offset would be recalculated to effectively rezero the offset calculation. Although the occurrence of additional downhole make-up should be a rare occurrence, it is advantageous that such downhole make-up be detectable fro the drill string 8.

Figure 3:
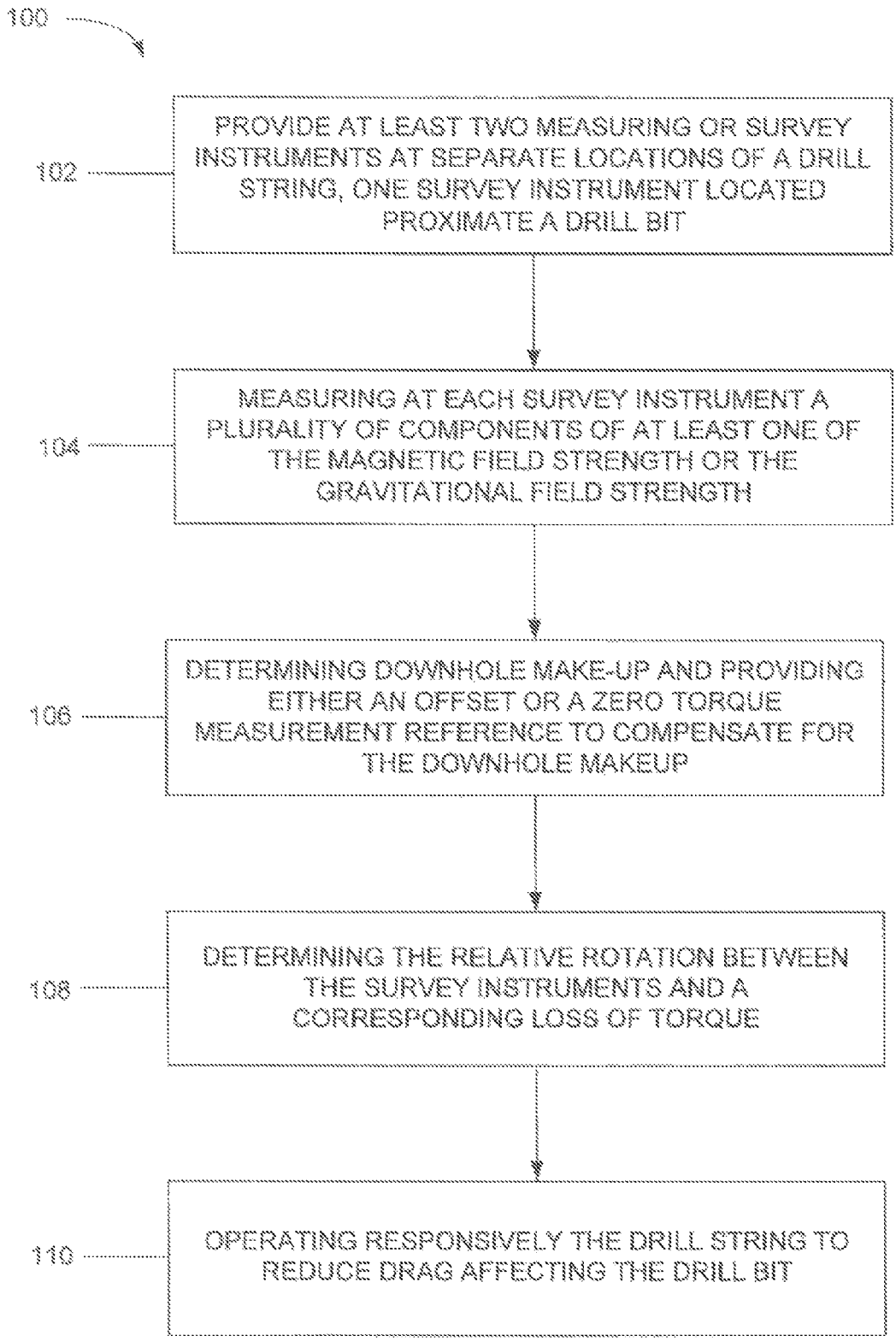
FIG. 3 is a flow chart diagram of an example process to control the rotation of a drill bit.

FIG. 3 is a representative flow diagram of an example process or method 100 to control the rotation of a drill bit and, more particularly, to utilize the downhole measurements of magnetometer or accelerometer assemblies to control efficiently the rotation of a drill bit to reduce drag affecting the drill bit. Initially, at block 102, the example method 100 includes providing at least two measuring or survey instruments (e.g., the survey instruments 21 and 22 in FIG. 1) at separate locations of a drill string (e.g., the drill string 8), such that one of the survey instruments (e.g., the survey instrument 22) is located proximate a drill bit (e.g., the drill bit 11). Each survey instrument (e.g., the survey instrument 21 in FIG. 2) then measures a plurality of components (e.g., corresponding to the axes X, Y, and Z in FIG. 2) of at least one of the magnetic field strength or the gravitational field strength (block 104). The measurements of the survey instruments are utilized (e.g., by the data processing system 24 in FIG. 1) to determine downhole make-up and provide either an offset or a zero torque measurement reference to compensate for the downhole make-up (clock 106). Next, at block 108, the example method 100 determines the relative rotation (e.g., using the data processing system 24 in FIG. 1) between the survey instruments (e.g., the survey instruments 21 and 22) and a corresponding loss of torque (e.g., using the equation 1). Then, the drill string (e.g., the drill string 8 containing the drill bit 11) can be operated responsively to reduce drag affecting the drill bit (block 110). For example, alternatively or in combination, the rotation of the drill string 8 may be varied, the weight of the drill bit 11 may be changed, the pump rate of the fluid or mud circulated may be charged, the properties of the mud may be varied, and/or a short trip may be performed.

An example apparatus and method for controlling the rotation of a downhole drill bit are described with reference to the flowchart illustrated in FIG. 3. However, persons of ordinary skill will readily appreciate that other methods of implementing the example method may alternatively be used. For example, the order of execution of the blocks may be changed, and/or some of the blocks described may be changed, eliminated, or combined.

Although a certain example apparatus and method have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. An apparatus to control a rotation of a drill bit in a borehole in an earth formation, comprising:

a first measuring instrument to be coupled at a first location of a drill string proximate the drill bit;

a second measuring instrument to be coupled at a second location of the drill string, wherein the second location is axially spaced from the first location, and wherein the measuring instruments include at least one of magnetometers or accelerometers to measure a plurality of components of a field strength; and a data processing system to communicate with the measuring instruments to process data associated with the components of the field strength to determine 1) a relative angle of rotation between the measuring instruments based on the first and second orientations of the locations while drilling by rotating the drill string and 2) a loss of torque transmitted to the drill bit, based on the relative angle of rotation.

2. An apparatus as claimed in claim 1, wherein the data processing system is configured to analyze the data to provide an offset to compensate for downhole make-up of the drill string.

3. An apparatus as claimed in claim 1, wherein the measuring instruments provide data from an axial displacement of the drill string, without rotation imparted to the drill string, to the data processing system to determine a zero torque reference.

4. An apparatus as claimed in claim 1, wherein the data processing system communicates with the measuring instruments via a mud telemetry system.

5. An apparatus as claimed in claim 1, wherein the data processing system communicates with the measuring instruments via a wire drill pipe system.

6. An apparatus as claimed in claim 1, wherein the measuring instruments are configured to measure the components during at least one of rotating drilling or sliding drilling.

7. An apparatus as claimed in claim 1, wherein the loss of torque transmitted to the drill bit, based on the relative angle of rotation, thereby enabling a reduction of drag affecting the drill bit of drag includes at least one of changing a speed of rotation of the drill string, changing a weight on the drill bit, changing a rate of fluid being circulated through the drill string, modifying the fluid circulated through the drill string, or cleaning the drill bit.

8. An apparatus as claimed in claim 1, further comprising at least a third survey instrument including at least one of a magnetometer or an accelerometer.

9. A method control from the surface of the earth a rotation of a drill bit to reduce drag affecting the drill bit, comprising:

providing survey instruments at a drill string, the survey instruments including at least one of magnetometer assemblies or accelerometer assemblies, the assemblies spaced apart from one another at locations along at least one of a drill pipe or drill collars of the drill string and at least one of the survey instruments positioned proximate the drill bit;

measuring the orientations of the locations during rotation of the drill string;

communicating the measured orientations to a data processing system;

determining a relative angle of rotation as to between the assemblies based on the orientations of the locations while drilling by rotating the drill string;

determining a loss of torque transmitted to the drill bit, based on the relative angle of rotation; and operating responsively the drill string to reduce drag affecting the drill bit based on the determined loss of torque.

10. A method as claimed in claim 9, further comprising determining downhole make-up of the drill string and providing an offset to compensate for the downhole make-up.

11. A method as claimed in claim 9 further comprising axially displacing the drill string without imparting rotation to the drill string to determine measurements of the survey instruments representing a zero torque reference.

12. A method as claimed in claim 9, wherein communicating the measured orientations includes using a mud telemetry system.

13. A method as claimed in claim 9, wherein communicating the measured orientations includes using a wire drill pipe system.

14. A method as claimed in claim 9, further comprising conducting at least one of rotating drilling or sliding drilling during the measuring of the orientations.

15. A method as claimed in claim 9, wherein the operating responsively the drill string includes at least one of changing the speed of rotation of the drill sting, changing the weight on the drill bit, changing the rate of fluid circulated through the drill string, modifying the fluid circulated through the drill string, or cleaning the drill bit.

16. A method as claimed in claim 9, wherein the survey instruments comprise at least three survey instruments.

17. A method to control the rotation of a drill string in a borehole in an earth formation to reduce drag affecting a drill bit, comprising:

measuring at spaced-apart locations in the borehole, with at least one of magnetic or gravitational field responsive measuring instruments, a plurality of components of a field strength, wherein one of the measuring instruments is proximate to the drill bit;

determining a relative angle of rotation as to between the measuring instruments based on orientations of the locations while drilling by rotating the drill string; and determining a loss of torque transmitted to the drill bit, based on the relative angle of rotation; and operating the drill string to reduce loss of torque affecting the drill bit.

18. A method as claimed in claim 17, further comprising determining downhole make-up of the drill string and providing an offset to compensate for the downhole make-up.

19. A method as claimed in claim 17, further comprising axially displacing the drill string in the borehole without imparting rotation to the drill string to generate measurements to determine a zero torque reference.

20. A method as claimed in claim 17, wherein the measuring instruments at the spaced-apart locations are within at least one of a drill pipe or drill collars.

21. A method as claimed in claim 17, wherein the measuring instruments are configured to measure the components during at least one of rotating drilling or sliding drilling.

22. A method as claimed in claim 13, wherein the operating the drill string includes at least one of changing a speed of rotation of the drill string, changing a weight on the drill bit, changing a rate of fluid circulated through the drill string, modifying the fluid circulated in the drill string, or cleaning the drill bit.

* * * * *